US012660909B2

(12) United States Patent
Fairbanks

(10) Patent No.: US 12,660,909 B2
(45) Date of Patent: Jun. 23, 2026

(54) MULTIPURPOSE CLEANING TOOL

(71) Applicant: William Cody Fairbanks, Sandy, UT (US)

(72) Inventor: William Cody Fairbanks, Sandy, UT (US)

( * ) Notice: Subject to any disclaimer, the term of this patent is extended or adjusted under 35 U.S.C. 154(b) by 42 days.

(21) Appl. No.: 18/417,774

(22) Filed: Jan. 19, 2024

(65) Prior Publication Data

US 2025/0234986 A1 Jul. 24, 2025

(51) Int. Cl.

| | |
|---|---|
| ***A46B 5/00*** | (2006.01) |
| ***A46B 9/02*** | (2006.01) |
| ***A47L 13/08*** | (2006.01) |
| ***A47L 13/16*** | (2006.01) |
| ***A47L 17/06*** | (2006.01) |
| ***A47L 17/08*** | (2006.01) |

(52) U.S. Cl.

CPC ..... *A46B 5/0008* (2013.01); *A46B 9/025* (2013.01); *A47L 13/08* (2013.01); *A47L 13/16* (2013.01); *A47L 17/06* (2013.01); *A47L 17/08* (2013.01); *A46B 2200/3033* (2013.01)

(58) Field of Classification Search

CPC ..... A47L 13/08; A47L 13/16; A47L 17/06; A47L 17/08; A47L 13/12; A47L 17/04; A46B 2200/3033; A46B 5/0008; A46B 9/025

See application file for complete search history.

(56) References Cited

U.S. PATENT DOCUMENTS 5,317,779 A * 6/1994 Hoagland ..... A47L 17/04 15/236.05
2011/0048457 A1* 3/2011 Dean ..... A46B 15/0002 15/171

FOREIGN PATENT DOCUMENTS

EP 2559520 A1 * 2/2013 ..... B24D 15/084

OTHER PUBLICATIONS

Machine translation of EP2559520A1 to Pauls (Year: 2013).*

* cited by examiner

*Primary Examiner* — Douglas Lee
(74) *Attorney, Agent, or Firm* — Jason R. Jones

(57) ABSTRACT

A multipurpose cleaning tool device is disclosed and described having a tool housing that includes an elongate handle sized to be held by a user when in use, a cleaning head coupled to one end of the elongate handle, a first cleaning material coupled to and extending away from a bottom surface of the cleaning head such that the first cleaning material defines a first surface cleaning interface, and a channel extending through the tool housing from a top surface of the tool housing to a bottom surface of the tool housing in a transverse direction to the first surface cleaning interface. The channel includes opposing layers of a second cleaning material positioned within the channel defining a second surface cleaning surface transversely oriented with respect to the first cleaning surface interface.

6 Claims, 4 Drawing Sheets

MULTIPURPOSE CLEANING TOOL

BACKGROUND

Traditional cleaning tools are often designed for specific tasks and surfaces, necessitating multiple different tools for different cleaning needs. In some cases, larger flat surfaces may be cleaned while in other cases smaller items may be cleaned. Often, however, cleaning jobs may need to be performed in environments where both larger flat surfaces and smaller items are cleaned simultaneously. In such situations, either multiple tools are used or a single tool is inefficiently used on a cleaning task for which it was not designed.

DESCRIPTION OF EMBODIMENTS

Figure 1A:
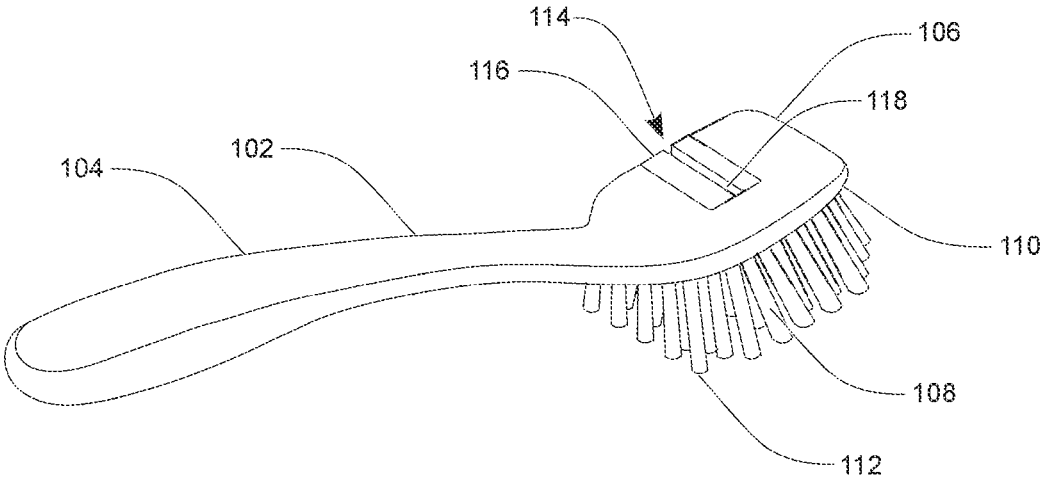
FIG. 1A shows a view of a multipurpose cleaning device in accordance with an example embodiment.

Although the following detailed description contains many specifics for the purpose of illustration, a person of ordinary skill in the art will appreciate that many variations and alterations to the following details can be made and are considered included herein. Accordingly, the following embodiments are set forth without any loss of generality to, and without imposing limitations upon, any claims set forth. It is also to be understood that the terminology used herein is for describing particular embodiments only and is not intended to be limiting. Unless defined otherwise, all technical and scientific terms used herein have the same meaning as commonly understood by one of ordinary skill in the art to which this disclosure belongs. Also, the same reference numerals appearing in different drawings represent the same element. Numbers provided in flow charts and processes are provided for clarity in illustrating steps and operations and do not necessarily indicate a particular order or sequence.

Furthermore, the described features, structures, or characteristics can be combined in any suitable manner in one or more embodiments. In the following description, numerous specific details are provided, such as examples of layouts, distances, ingredients, etc., to provide a thorough understanding of various embodiments. One skilled in the relevant art will recognize, however, that such detailed embodiments do not limit the overall concepts articulated herein but are merely representative thereof. One skilled in the relevant art will also recognize that the technology can be practiced without one or more of the specific details, or with other methods, components, layouts, etc. In other instances, well-known structures, materials, or operations may not be shown or described in detail to avoid obscuring aspects of the disclosure.

In this application, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open-ended term in this written description, like "comprising" or "including," it is understood that direct support should be afforded also to "consisting essentially of" language as well as "consisting of" language as if stated explicitly and vice versa.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a given term, metric, value, range endpoint, or the like. The degree of flexibility for a particular variable can be readily determined by one skilled in the art. However, unless otherwise expressed, the term "about" generally provides flexibility of less than 1%, and in some cases less than 0.01%. It is to be understood that, even when the term "about" is used in the present specification in connection with a specific numerical value, support for the exact numerical value recited apart from the "about" terminology is also provided.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 1.5, 2, 2.3, 3, 3.8, 4, 4.6, 5, and 5.1 individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of phrases including "an example" or "an embodiment" in various places throughout this specification are not necessarily all referring to the same example or embodiment.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

An initial overview of embodiments is provided below, and specific embodiments are then described in further detail. This initial summary is intended to aid readers in understanding the disclosure more quickly and is not intended to identify key or essential technological features, nor is it intended to limit the scope of the claimed subject matter.

Many traditional cleaning brushes, such as kitchen brushes (scrub brushes) used to clean dishes, sinks, and counters, are limited in their application and utility. For example, a traditional brush generally a single cleaning region to interface with and clean a given surface, dish, or the like. A cleaning interface is used herein to describe a region of the scrub brush that is designed to contact a surface or object to be cleaned. In bristled scrub brush, for example, the ends of the bristles oriented away from the bristled scrub brush can be described as a cleaning interface, as they contact and move across a surface that is being cleaned.

In general, traditional cleaning brushes are limited by the type of surface they are designed to clean. Switching to a different type or size of surface generally necessitates a change to a different brush type or switching to a different brush head attachable to a common handle. As such, a number of brushes/cleaning heads are required to handle the various cleaning jobs in, for example, a traditional kitchen. Additionally, the cleaning interface of a traditional scrub brush is not an ideal for cleaning cutlery, glassware, and the like. In the case of cutlery, for example, a traditional scrub brush can only clean one side of the item at a time, often deployed in an awkward motion due to the broad flat shape of most cleaning interfaces.

The present disclosure provides a multipurpose cleaning device (cleaning device) capable of cleaning single-sided support surfaces, sinks, work areas, cutting boards, kitchenware, cookware, and the like, while also allowing the cleaning of smaller handheld items, such as kitchen utensils, cutlery, glassware, and the like, on both sides without modification to the device. As such a user holding the cleaning device could scrub a sink, then pick up a utensil, insert it into the channel from the side and pull the utensil upward, allowing two opposing cleaning channel materials to clean debris from both sides of the utensil, switching back and forth as the person cleaned.

In one example, a cleaning device includes a tool housing including an elongate handle sized to be held by a user when in use, a cleaning head coupled to one end of the elongate handle, a first cleaning material coupled to and extending away from a bottom surface of the cleaning head such that the first cleaning material defines a first surface cleaning interface, a channel extending through the tool housing from a top surface of the tool housing to a bottom surface of the tool housing in a transverse direction to the first surface cleaning interface, and opposing layers of a second cleaning material positioned within the channel defining a second surface cleaning surface transversely oriented with respect to the first cleaning surface interface.

One example, as is shown in FIG. 1A, includes a tool housing 102 that further includes an elongate handle 104 coupled to a cleaning head 106 at one end. The elongate handle can be aligned along the same linear axis as the cleaning head or, as shown in FIG. 1A, the elongate handle 104 can be angled upward away from the cleaning head 106 to allow, among other things, comfortable space between the user's hand and the surface being cleaned and can thus be sized to be comfortably held by a user, facilitating ease of use across various cleaning tasks. The elongate handle is also contemplated to be in any position relative to the cleaning head that allows the functionality of the cleaning device as disclosed herein.

The cleaning head 106 further includes a first cleaning material 108 coupled to and extending away from a bottom surface 110 of the cleaning head 106. In the example shown in FIG. 1A, the first cleaning material 108 is a plurality of bristles. The first cleaning material 108 thus defines a first surface cleaning interface 112 of the cleaning tool used to clean large surfaces and items with large surface areas. A user can thus grasp the cleaning tool by the elongate handle 104, contact the first cleaning interface 112 of the first cleaning material 108 against a surface and then move the cleaning tool relative to the surface to facilitate cleaning by the first cleaning material 108.

The tool housing 102 further includes a channel 114 extending through the tool housing 102 from a top surface of the tool housing to a bottom surface of the tool housing in a direction that is transverse direction to the first cleaning surface. The example of FIG. 1A shows the channel extending from a top surface to a bottom surface through the cleaning head 106 transverse to the first cleaning surface 110. Opposing layers of a second cleaning material 116 are coupled within the channel 114 and define a second cleaning surface 118 transverse to the first cleaning surface 110.

Figure 1B:
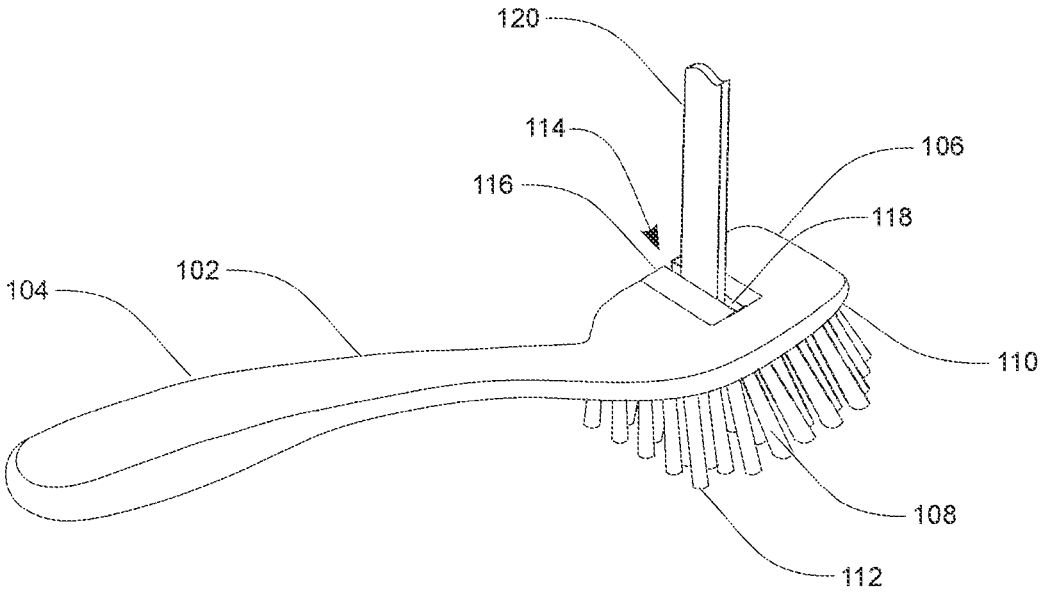
FIG. 1B shows a view of a multipurpose cleaning device cleaning a kitchen utensil in accordance with an example embodiment.

FIG. 1B shows the example of FIG. 1A with a kitchen utensil 120, such as a knife for example, inserted into the channel 114 between the opposing second cleaning material layers 116, thus contacting opposing sides of the kitchen utensil 120 at the second cleaning interface 118. By moving the kitchen utensil 120 relative to the channel 114, the opposing layers of the second cleaning material 116 engage both sides of the kitchen utensil 120 simultaneously to remove debris.

The elongate handle of the device is specifically sized and shaped to be comfortably held in one hand of the user during use. This design facilitates ease of maneuverability and control, allowing the user to efficiently clean surfaces without undue strain. The channel is positioned and oriented with respect to the elongate handle in such a manner that when the device is held in one hand, a kitchen item held in the user's other hand can be easily moved through the second cleaning surface. This design ensures that both sides of the kitchen item are simultaneously contacted by the opposing layers of the second cleaning material, providing effective and efficient cleaning.

In various different examples, the channel can be located to extend through the cleaning head, the elongate handle, or at the boundary between the elongate handle and the cleaning head from its top surface to its bottom surface. It is contemplated that the channel can be located at any position and transverse orientation along the tool housing that allows the cleaning device to be maintained in a comfortable position relative to the first cleaning interface that allows smaller handheld items to be cleaned at the second cleaning interface. The design thus allows a user to comfortably maintain the cleaning tool in a position whereby surfaces can be cleaned with the first cleaning material while cleaning the smaller items, such as kitchen utensils, in a seamless cleaning experience without the need to switch tools, awkwardly reposition the cleaning tool, rotate the smaller item to clean both sides, or the like.

Figure 1C:
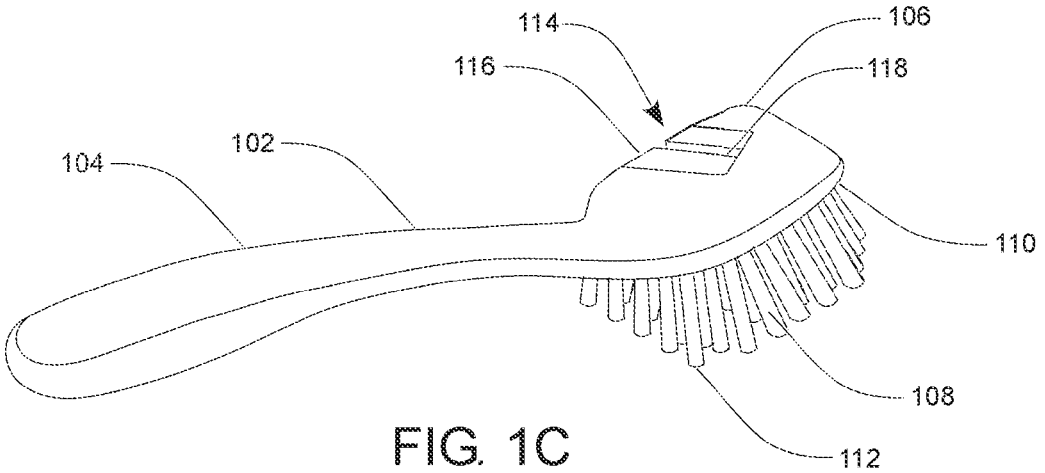
FIG. 1C shows a view of a multipurpose cleaning device in accordance with an example embodiment.

The channel 114 can be positioned in the tool housing 102 in various positions, locations, and orientations, depending on the desired design of a given cleaning device. While the channels shown in FIGS. 1A and 1B were at least substantially orthogonally aligned relative to the tool housing 102, FIG. 1C shows one example of the cleaning device where the channel 114 is obliquely aligned with the tool housing 102. It is noted that in some cases such alignment can be achieved by the physical shape and alignment of the second cleaning materials irrespective of the alignment of the channel. For example, the channel 114 may be substantially orthogonal to the tool housing 102, but the second cleaning interface 118 may be obliquely oriented relative to the tool housing 102 due to the shape and positioning of the opposing layers of the second cleaning material 116 in the channel 114.

It is noted that the physical configuration of the channel can vary depending on design and/or use preference. For example, different sizes and/or shapes can be beneficial for different cleaning tasks, different users, different cleaning environments, etc. In other words, a different channels of different tool designs can have different cross sections through the tool housing (i.e., a cross section in a parallel orientation relative to the first cleaning surface through the cleaning head). The same concept applies to the second cleaning interface, where different sizes and shapes can be created in a given tool due to changing the cross section of the opposing second cleaning materials within the channel.

Figure 1D:
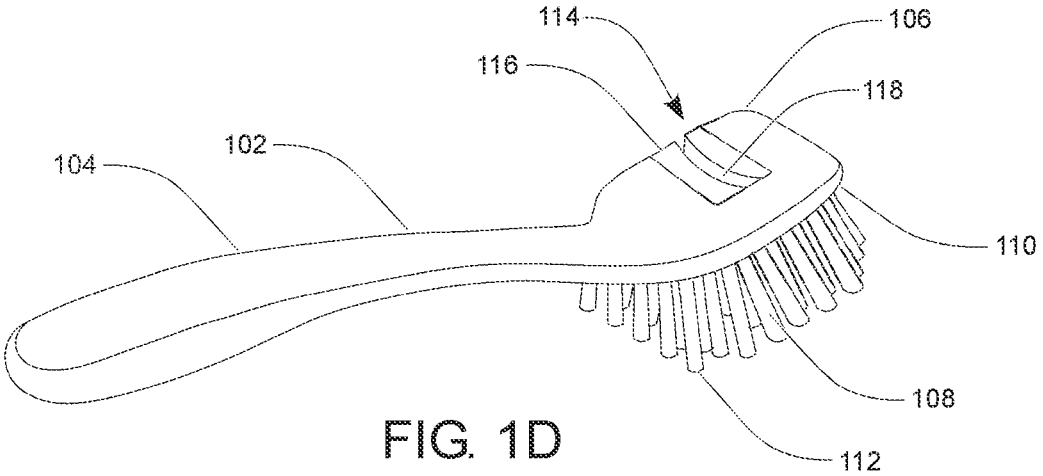
FIG. 1D shows a view of a multipurpose cleaning device in accordance with an example embodiment.

Other configurations to the second cleaning interface are additionally contemplated that may benefit certain designs, cleaning situations, and/or user preferences. FIG. 1D shows an example of a cleaning device whereby the second cleaning interface 118 has a nonlinear shape. As describe above, this nonlinear shape (or nonlinear cross section through the cleaning head parallel to the first leaning interface has a nonlinear shape. Any useful nonlinear shape is contemplated, including the arc shape shown in FIG. 1D. In similar terminology, the cross sections of the channels 114 in FIGS. 1A and 1B are substantially orthogonal to the tool housing 102.

As has been described, opposing layers of a secondary material are positioned within the channel to form a second cleaning interface to facilitate the simultaneous cleaning of smaller thin items that fit within the channel. It is noted that the term "smaller thin items" may include not only items that fully fit within the channel, but larger item that are too big for the channel but have a two-sided edge that does fit and can be cleaned therein. A variety of such secondary materials are contemplated and should not be seen as limiting. The opposing layers of a secondary material can each be the same type of material in some cases. In some examples, each of the opposing layers of the second cleaning material are the same type of material and can include such materials as, without limitation, opposing synthetic sponges, opposing abrasive materials, pluralities of opposing bristles, opposing polymeric scrapers, and the like. In other examples, each of the opposing layers of the second cleaning material is a different material type which can independently include, without limitation, a synthetic sponge, an abrasive material, a plurality of bristles, a polymeric scraper, or the like.

Figure 2:
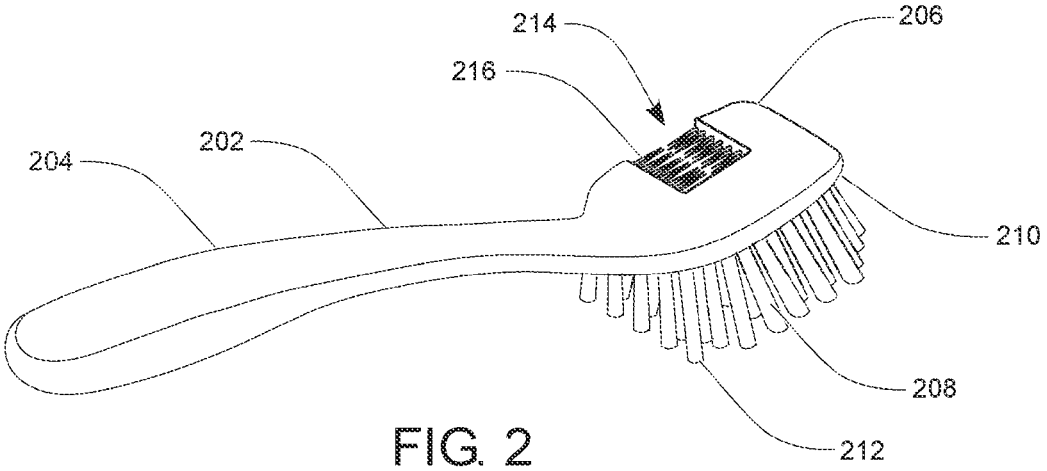
FIG. 2 shows a view of a multipurpose cleaning device in accordance with an example embodiment.

As another example, FIG. 2 shows a tool housing 202 that further includes an elongate handle 204 coupled to a cleaning head 206 at one end. The cleaning head 206 further includes a first cleaning material 208 coupled to and extending away from a bottom surface 210 of the cleaning head 206. In the example shown in FIG. 2, the first cleaning material 208 is a plurality of bristles. The first cleaning material 208 thus defines a first surface cleaning interface 212 of the cleaning tool used to clean large surfaces and items with large surface areas.

The tool housing 202 further includes a channel 214 extending through the tool housing 202 from a top surface of the tool housing to a bottom surface of the tool housing in a direction that is transverse direction to the first cleaning surface interface 212. The example of FIG. 2 shows the channel extending from a top surface to a bottom surface through the cleaning head 206 transverse to the first cleaning surface interface 210. Opposing layers of a second cleaning material 216 are coupled within the channel 214 and define a second cleaning surface interface 218 transverse to the first cleaning surface interface 212. In this example, the opposing layers of the second cleaning material 216 are opposing layers of bristles.

Figure 3A:
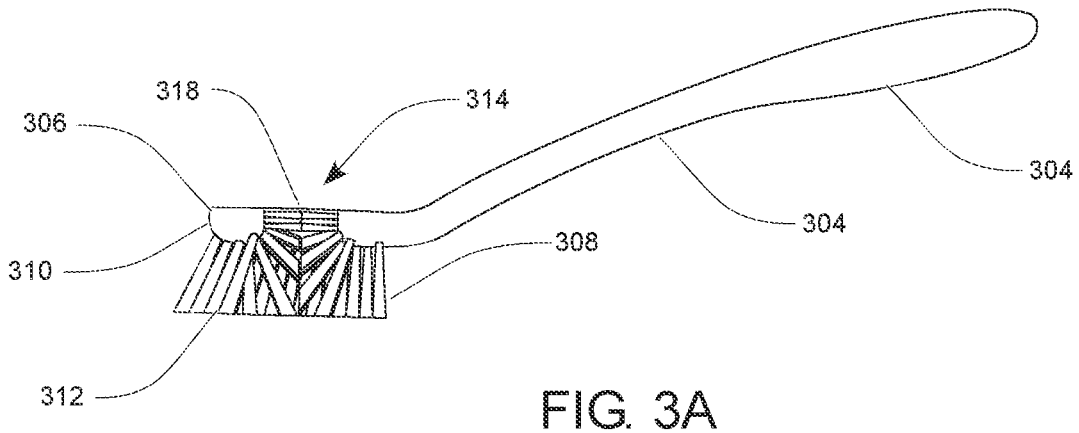
FIG. 3A shows a view of a multipurpose cleaning device in accordance with an example embodiment.
Figure 3B:
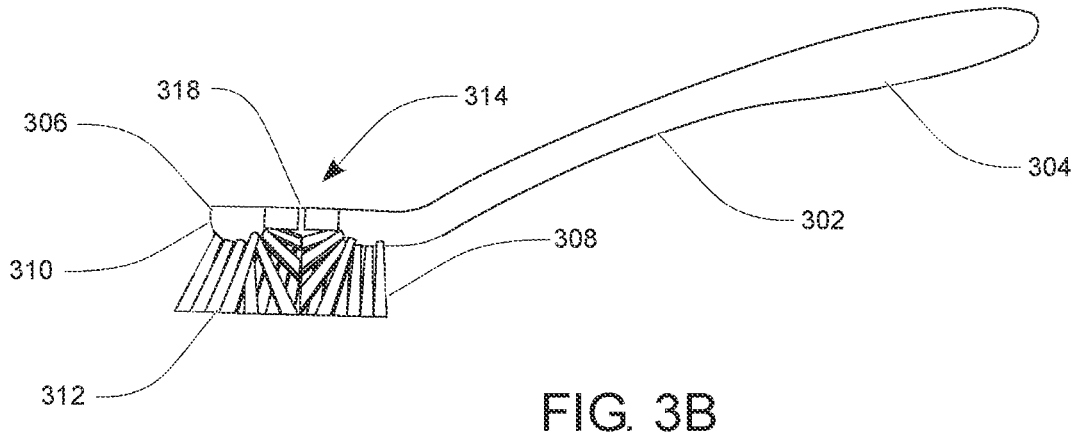
FIG. 3B shows a view of a multipurpose cleaning device in accordance with an example embodiment.

FIGS. 3A and 3B show side views of a cleaning tool having a tool housing 302 that further includes an elongate handle 304 coupled to a cleaning head 306 at one end. The cleaning head 306 further includes a first cleaning material 308 coupled to and extending away from a bottom surface 310 of the cleaning head 306. In the example shown in FIGS. 3A and 3B, the first cleaning material 308 is a plurality of bristles. The first cleaning material 308 defines a first surface cleaning interface 312 of the cleaning tool used to clean large surfaces and items with large surface areas.

The tool housing 302 further includes a channel 314 extending through the tool housing 302 from a top surface of the tool housing to a bottom surface of the tool housing in a direction that is transverse direction to the first cleaning surface. The example of FIGS. 3A and 3B shows the channel extending from a top surface to a bottom surface through the cleaning head 306 transverse to the first cleaning surface interface 312. Opposing layers of a second cleaning material 316 are coupled within the channel 314 and define a second cleaning surface interface 318 transverse to the first cleaning surface interface 112. In the example of FIG. 3A, the opposing layers of the second cleaning material 316 are opposing layers of bristles while in the example of FIG. 3B, the opposing layers of the second cleaning material 316 are opposing sponge materials.

Figure 4:
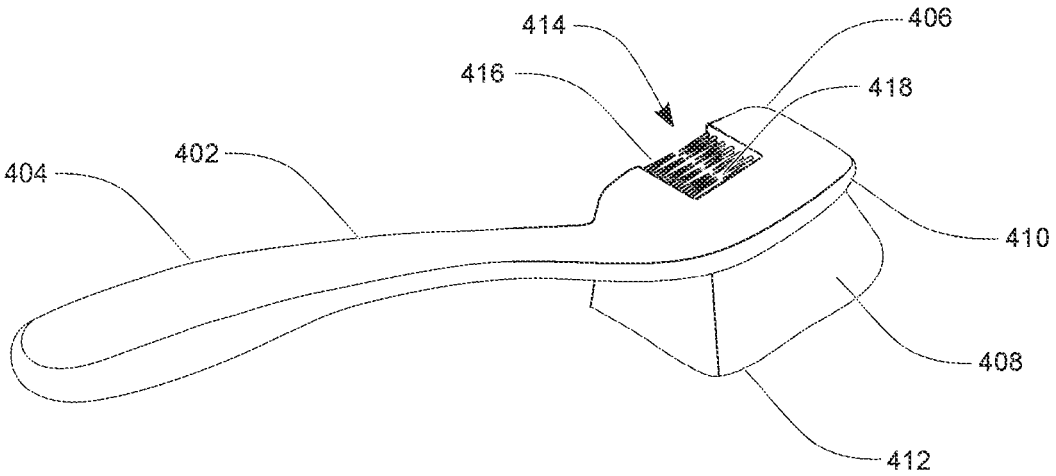
FIG. 4 shows a view of a multipurpose cleaning device in accordance with an example embodiment.

FIG. 4 shows a nonlimiting example of a cleaning tool having a tool housing 402 that further includes an elongate handle 404 coupled to a cleaning head 406 at one end. The cleaning head 406 further includes a first cleaning material 408 coupled to and extending away from a bottom surface 410 of the cleaning head 406. In the example shown in FIG. 4, the first cleaning material 408 is a synthetic sponge or other spongy polymeric material. The first cleaning material 408 defines a first surface cleaning interface 412 of the cleaning tool used to clean large surfaces and items with large surface areas.

The tool housing 402 further includes a channel 414 extending through the tool housing 402 as has been described previously. In this particular example, opposing layers of the a second cleaning material located within the channel 414 are opposing layers of pluralities of bristles that come together to form the second cleaning interface 418.

Figure 5:
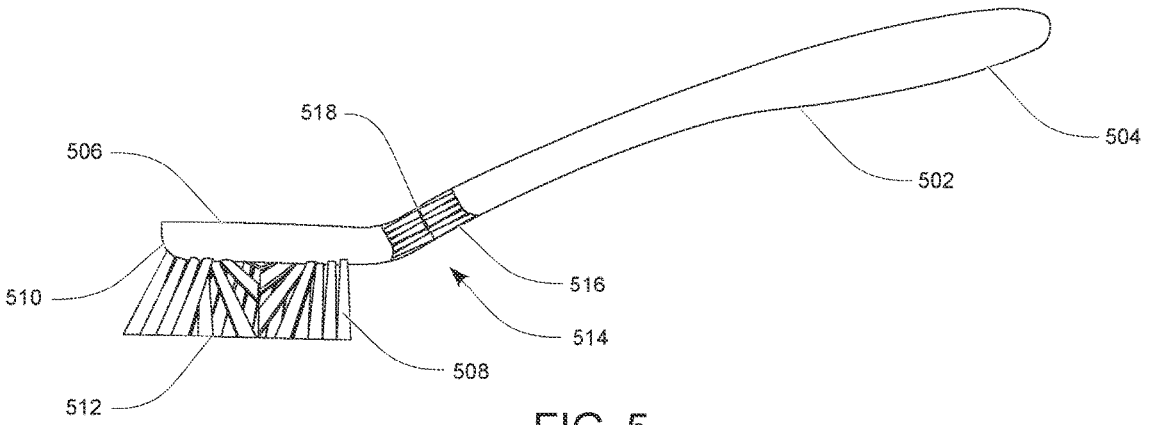
FIG. 5 shows a view of a multipurpose cleaning device in accordance with an example embodiment.

FIG. 5 shows a side view of a cleaning tool having a tool housing 502 that further includes an elongate handle 504 coupled to a cleaning head 506 at one end. The cleaning head 506 further includes a first cleaning material 508 coupled to and extending away from a bottom surface 510 of the cleaning head 506. In the example shown in FIG. 5, the first cleaning material 508 is a plurality of bristles. The first cleaning material 508 defines a first surface cleaning interface 512 of the cleaning tool used to clean large surfaces and items with large surface areas.

The tool housing 502 further includes a channel 514 extending through the tool housing 502 from a top surface of the tool housing 502 to a bottom surface of the tool housing in a direction that is transverse direction to the first cleaning surface 512. The example of FIG. 5 shows the channel 514 positioned away from the first cleaning material 608 and the cleaning head 506. The location of the cleaning channel 514 in this example can be in the elongate handle 504, at an interface between the elongate handle 504 and the cleaning head 506, or in the cleaning head 506 but separated apart from the first cleaning material 508. In this example, opposing layers of the second cleaning material 516 are, without limitation, opposing layers of pluralities of bristles.

Figure 6:
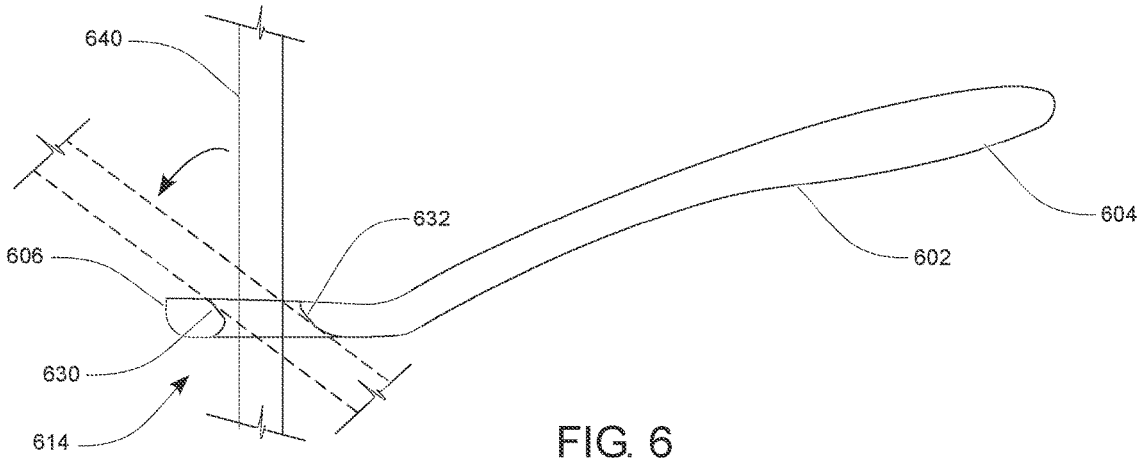
FIG. 6 shows a view of a multipurpose cleaning device cleaning a kitchen utensil, and also showing modified leverage on the sides of the kitchen utensil as a result of modification to the design of the channel in accordance with an example embodiment.

In other examples, it is contemplated that the shape and structure of the channel can be designed to enhance the cleaning force applied to the item being cleaned therein. For example, as is shown in FIG. 6, a cleaning tool includes a tool housing 602 that further includes an elongate handle 604 coupled to a cleaning head 606 at one end. The tool housing 602 further includes a channel 614 extending through the tool housing 602 (in this case, the cleaning head 606 portion) from a top surface of the tool housing 602 to a bottom surface of the tool housing. First and second cleaning materials are not shown for clarity. The channel 614 can include structures to increase the force that can be applied to an item being positioned within the channel. In this example, a bevels 630 and 632 are relatively positioned, in this case on an upward forward region (630) and a downward backward region (632) of the channel 614. An item 640 to be cleaned is shown positioned within the channel 614 in an upright initial position (solid lines). When cleaning the item 640, the user can rotate it forward (dashed lines) such that it contacts the beveled regions 630 and 632, thus increasing the force applied by the channel 614 on the item 640 to improve the cleaning efficiency. It is noted that the positioning of the bevels 630 and 632 can be reversed to facilitate a backward rotation in some examples.

It is further noted that, while the cleaning tool has been shown with the channel located on the left side of the tool housing, such is not limiting. Other examples are contemplated where the channel can be located on the right side of the tool housing to accommodate user preferences, such as handedness. It is additionally noted that, while the second cleaning materials have been shown as if they were coupled directly to the tool housing in the channel, in many cases the second cleaning materials can be affixed into an insert that is then physically coupled into the channel cutout of the tool housing.

In yet another example, the present disclosure provides a method for cleaning a work area. Such a method includes contacting a cleaning tool as disclosed herein to a surface such that the first cleaning material engages the surface at the first cleaning surface interface and moving the multipurpose cleaning tool device relative to the surface. The friction and movement of the cleaning tool across the surface removes debris from the surface. While larger surfaces are being cleaned, a user can hold the elongate handle in one hand and pick up a tool or kitchen utensil in the other. An edge of the utensil or tool is then inserted into the channel of the cleaning tool such that the opposing layers of the second cleaning material engage tool surfaces on opposing sides of the tool. Once in position, moving the tool relative to the channel causes opposing layers of the second cleaning material to create friction to remove debris from the opposing sides of the tool. It is noted that in some examples the cleaning tool can be used in work areas such as a kitchen area, where the surface is a kitchen surface, kitchen cookware, kitchen dinnerware, or the like.

The invention claimed is:

1. A multipurpose cleaning tool device, comprising:

a tool housing including:

an elongate handle sized to be held by a user when in use;

a cleaning head coupled to one end of the elongate handle;

a first cleaning material coupled to and extending away from a bottom surface of the cleaning head such that the first cleaning material defines a first surface cleaning interface;

a channel extending through the tool housing from a top surface of the tool housing to a bottom surface of the tool housing in a transverse direction to the first surface cleaning interface; and opposing layers of a second cleaning material positioned within the channel defining a second surface cleaning surface transversely oriented with respect to the first cleaning surface interface; wherein the channel extending through the tool housing extends through the elongate handle of the tool housing from a top surface of the elongate handle to a bottom surface of the elongated handle in a transverse direction to a longitudinal axis of the elongate handle.

2. The device of claim 1, wherein the elongate handle is sized to be held in one hand of a user during use.

3. The device of claim 1, wherein the channel is positioned and oriented with respect to the elongate handle such that, when held in one hand by a user by the elongate handle, a kitchen item held in the user's other hand can readily be moved through the second cleaning surface in a direction transverse to the first cleaning surface, whereby opposing sides of the kitchen item are each contacted by one of the opposing layers of the second cleaning material simultaneously.

4. The device of claim 1, wherein the first cleaning material is a plurality of bristles extending away from the bottom surface of the cleaning head.

5. The device of claim 4, wherein ends of the plurality of bristles opposite the bottom surface of the cleaning head define the first surface cleaning interface.

6. The device of claim 1, wherein each of the opposing layers of the second cleaning material are the same type of material selected from opposing synthetic sponges, opposing abrasive materials, pluralities of opposing bristles, opposing polymeric scrapers.

* * * * *